US005513420A

United States Patent [19]

Kennedy

[11] Patent Number: 5,513,420

[45] Date of Patent: May 7, 1996

[54] HINGE ASSEMBLY FOR REFRIGERATED DISPLAY CABINET

[75] Inventor: Thomas E. Kennedy, Niles, Mich.

[73] Assignee: Tyler Refrigeration Corporation, Niles, Mich.

[21] Appl. No.: 238,188

[22] Filed: May 4, 1994

[51] Int. Cl.[6] ..... E05D 5/02; E05F 1/10

[52] U.S. Cl. ..... 16/289; 16/298; 16/252; 16/305; 16/306; 312/139

[58] Field of Search ..... 16/223, 252, 289, 16/291, 297, 305, 306, 382, 298; 312/116, 139, 319.2

[56] References Cited

U.S. PATENT DOCUMENTS

| | | | |
|---|---|---|---|
| 4,312,097 | 1/1982 | Boyd | 16/289 |
| 4,365,385 | 12/1982 | Gotoh | 16/382 |
| 4,658,473 | 4/1987 | Schema | 16/289 |
| 4,660,251 | 4/1987 | Watabe | 16/289 |
| 4,842,349 | 6/1989 | Stenemann | 312/116 |
| 5,116,274 | 4/1992 | Artwohl | 312/116 |
| 5,207,490 | 5/1993 | Kaspar et al. | 312/139 |

FOREIGN PATENT DOCUMENTS

| | | | |
|---|---|---|---|
| 3313914 | 10/1984 | Germany | 312/139 |
| 3503340 | 8/1986 | Germany | 312/116 |

*Primary Examiner*—Daniel W. Howell
*Assistant Examiner*—Donald M. Gurley
*Attorney, Agent, or Firm*—Baker & Daniels

[57] ABSTRACT

The invention is directed to a hinge assembly for pivotably interconnecting a frame and a glass door of a refrigerated display case. The hinge assembly is pivotable about a horizontal axis and includes a hinge movable between a first position and a second position. The hinge includes a spring biasing device for biasing the hinge to the first position or second position. A clamp is connected to the hinge and holds the glass door using only frictional force.

15 Claims, 2 Drawing Sheets

HINGE ASSEMBLY FOR REFRIGERATED DISPLAY CABINET

BACKGROUND OF THE INVENTION

1. Field of the Invention

The present invention relates to a hinge for a refrigerated display case, and, more particularly, to a hinge for a refrigerated display case which is adapted to pivot a door, such as a glass door, about a horizontal axis and hold the door in an upward open position.

2. Description of the Related Art

A refrigerated storage cabinet, such as a chest freezer, includes a top door which pivots about a horizontal axis at the rear of the chest freezer. When loading items into or removing items from the chest freezer, it is necessary that the door remain in an upward open position. To maintain the door in the open position, it is known to utilize a tension spring in conjunction with the hinge, whereby the door is held in the open position.

Refrigerated display cases typically include a glass front wall so that a customer may view the items stored therein. To improve the thermal efficiency of such a display case, the glass door may be formed from thermopane glass, i.e., double pane glass. The thermopane glass door may be hinged at a top edge thereof, and pivot about a horizontal axis. Such thermopane glass is quite heavy when compared with single pane glass, and therefore may be difficult to hold in an open position when loading items into or removing items from the display case, or when cleaning the interior of the display case.

One solution for maintaining a thermopane glass door of a refrigerated display case in an open position is to utilize a hinge equipped with a gas cylinder for biasing the thermopane glass door to the open position. Such a device is disclosed by U.S. Pat. No. 5,116,274 (Artwohl et al). To attach the hinge to the glass, a clamp assembly having two pieces is utilized. The first piece is rigidly attached to the hinge, and a second piece is adjustably connected to the first piece, and coacts with the first piece to sandwich an upper edge of the glass door therebetween.

A problem with a hinge which biases a thermopane glass door to an open position utilizing a gas cylinder is that the gas cylinder has a relatively limited life span. Typically, after a few thousand cycles of opening and closing, the gas cylinder may fail and need to be replaced. Such replacement of the gas cylinder increases the maintenance costs associated with the refrigerated display case. Moreover, upon failure of the gas cylinder, the glass door may no longer be biased to an open position and cause an inconvenience to customers because of the necessity to manually hold the glass door open. Additionally, failure of the gas cylinder may pose a possible safety hazard if the door should fall to the closed position via gravitational force.

What is needed in the art is a hinge assembly for a refrigerated display case which effectively engages the glass door, and biases the glass door to an open position with increased reliability.

SUMMARY OF THE INVENTION

The present invention provides a hinge assembly including a spring biased hinge and a clamp for frictionally engaging a glass door, and having increased reliability over known structures.

The invention includes, in one form thereof, a hinge assembly for interconnecting a frame and a glass door of a refrigerated display case. The hinge assembly is pivotable about a horizontal axis and includes a hinge movable between a first position and a second position. The hinge includes a spring biasing device for biasing the hinge into the first position or second position. A clamp is connected to the hinge and holds the glass door using only frictional force.

An advantage of the present invention is that a horizontally pivoting glass door of a refrigerated display case can be maintained in an open position with increased reliability.

Another advantage is that the hinge assembly is capable of maintaining the door in an upright position for a greater number of operational cycles, and thereby reduces maintenance costs associated with the refrigerated display case.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
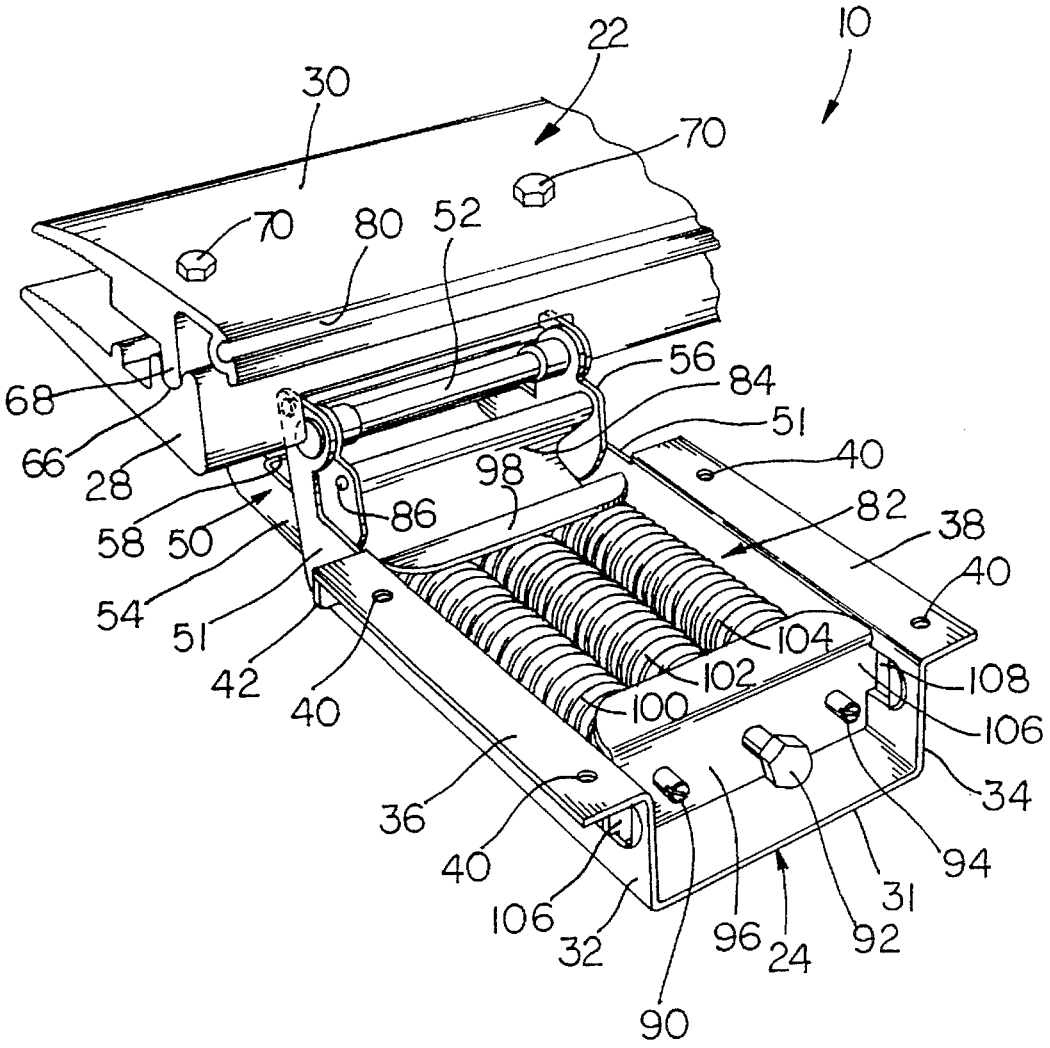
FIG. 1 is a perspective view of an embodiment of the hinge assembly of the present invention.
Figure 2:
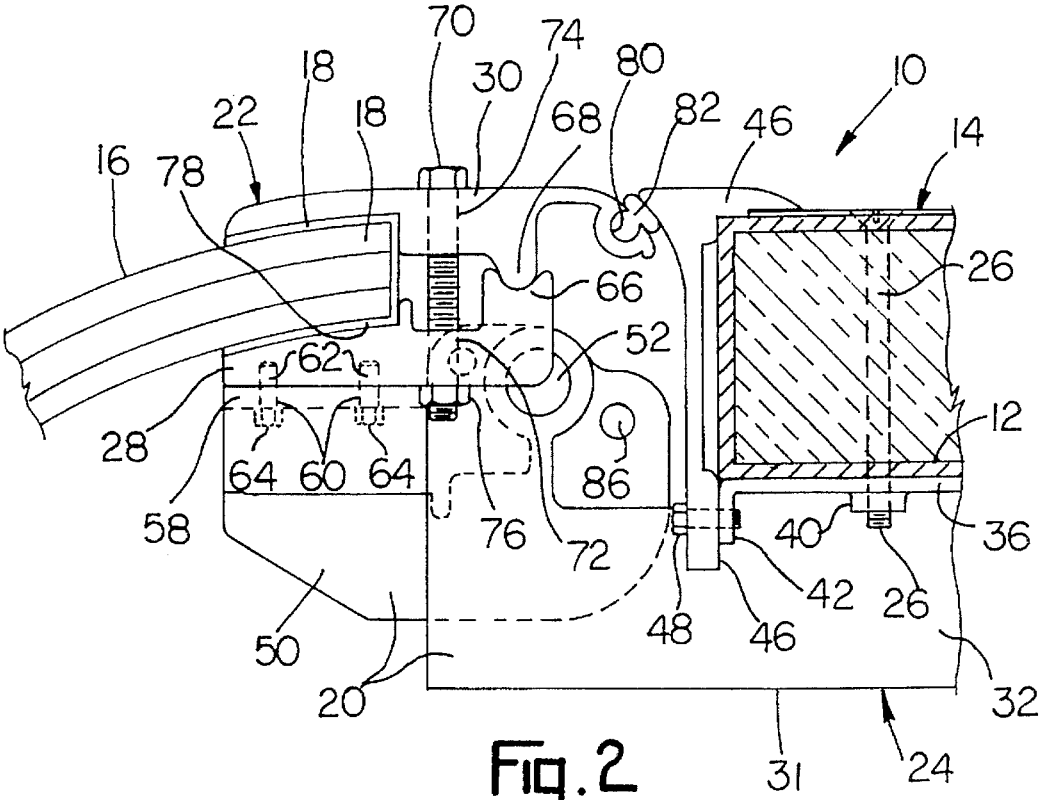
FIG. 2 is a side sectional view of the embodiment of FIG. 1, shown attached to an upper frame member and glass door of a display case.
Figure 3:
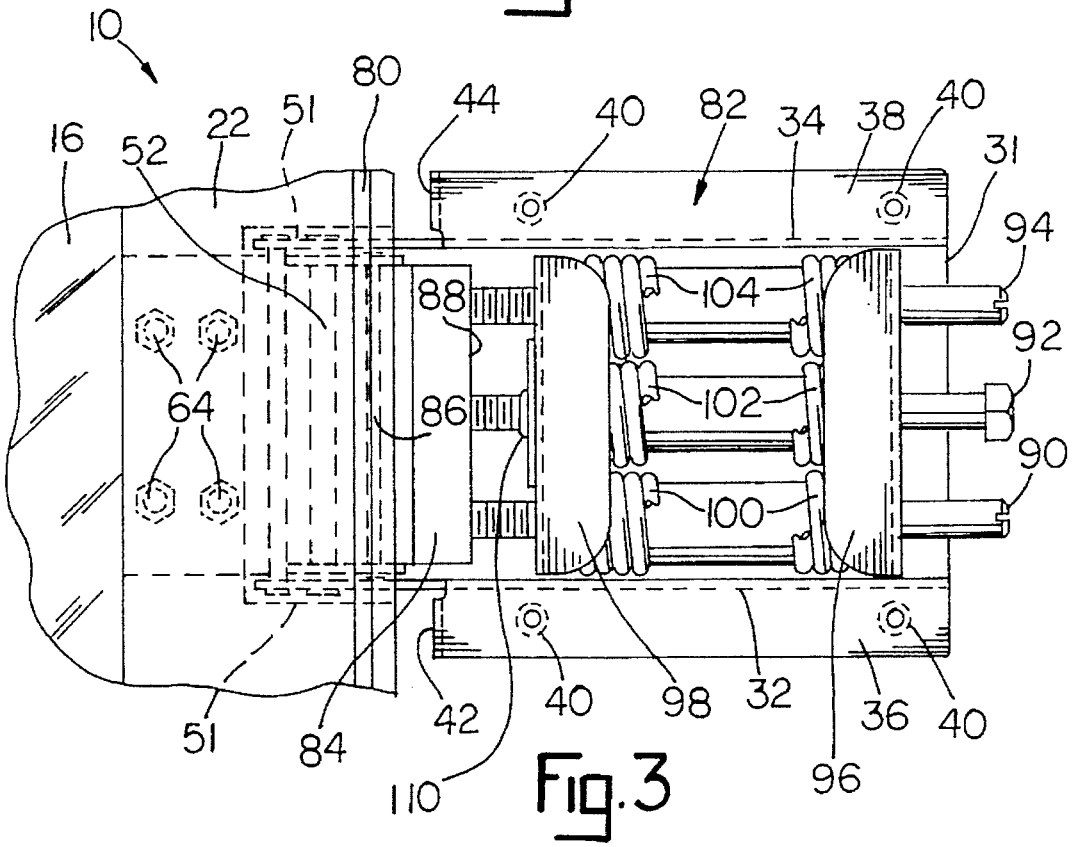
FIG. 3 is a top view of the embodiment shown in FIG. 1, shown attached to a glass door.

Referring now to the drawings, and more particularly to FIGS. 1–3, there is shown a hinge assembly 10 of the present invention which is adapted for use in a refrigeration display cabinet including a top frame member 12 of a frame 14, and a glass door 16. In the embodiment shown, glass door 16 is a thermopane glass door, i.e., double pane glass door, and is pivoted about a horizontal axis at an upper edge 18 thereof.

Hinge assembly 10 generally includes a hinge 20 and a clamp 22. Hinge 20 includes a generally U-shaped mounting bracket 24 secured to an underside of top frame member 12 by suitable means, such as a plurality of threaded bolts 26, one of which is shown in FIG. 2. Clamp 22 includes a first part 28 and a second part 30 which are of extruded metal and extend along the entire length of upper edge 18 of glass door 16. In the embodiment shown, a hinge 20 is disposed approximately every two feet along the length of, and attached to, clamp 22. However, it is to be appreciated that the relative spacing between each respective hinge 20 may vary. For purposes of discussion, a single hinge 20, as shown in FIGS. 1–3, is described herein.

Mounting bracket 24 includes a bottom plate 31 with a pair of depending legs 32, 34 extending upwardly therefrom. Disposed at the top of each respective leg 32, 34, and extending outwardly therefrom, are respective depending flanges 36, 38. Flanges 36, 38 include internally threaded bosses 40 for threadedly receiving threaded bolts 26. Extending downwardly from each flange 36, 38 is a respective shoulder 42, 44 adapted for connection to a top shelf trim piece 46 by suitable means, such as threaded bolts 48, one of which is shown in FIG. 2.

A pivot plate 50 is pivotally connected to uprights 51 of mounting bracket 24 via a rod 52. More particularly, pivot plate 50 includes a first vertically extending member 54 and a second vertically extending member 56 with respective openings (not numbered) therein for receiving rod 52. Extending between and interconnecting first vertically extending member 54 and second vertically extending member 56 is a transverse plate 58 having a plurality of openings 60 formed therein.

Clamp 22 is attached to pivot plate 50 of hinge 20. To wit, first part 28 includes a plurality of internally threaded openings 62 which are disposed in coaxial alignment with openings 60 of transverse plate 58. Respective bolts 64 pass through openings 60 and are threadedly received within openings 62.

Second part 30 of clamp 22 is adjustably connected to first part 30, whereby an adjustable clamping force may be exerted upon upper edge 18 of glass door 16. In particular, first part 28 includes a female concave portion 66 which extends parallel with and is spaced apart from upper edge 18 of glass door 16. Moreover, second part 30 includes a male convex portion 68 which extends parallel with and is spaced from upper edge 18 and mates with female concave portion 66. Female concave portion 66 and male convex portion 68 define a pivot point about which first part 28 and second part 30 may pivotally move relative to each other. Disposed between female concave portion 66, male convex portion 68 and upper edge 18 are a plurality of bolts 70 which extend through respective openings 72, 74 of first part 28 and second part 30. Bolts 70 threadably receive a nut 76; however, it is to be understood that one or the other of openings 72, 74 could be threaded and nut 76 eliminated.

As is apparent upon an examination of FIG. 2, tightening nuts 76 on bolts 70 causes first part 28 and second part 30 to pivot relative to each other about the pivot point defined by female concave portion 66 and male convex portion 68, whereby an adjustable clamping pressure may be exerted upon upper edge 18 of glass door 16. Preferably, an elastomeric seal 78 is disposed between upper edge 18 and each of first part 28 and second part 30 to act as a seal and to provide a cushion therebetween.

Second part 30 of clamp 22 includes a recess 80 at an edge thereof which is disposed adjacent to top shelf trim piece 46. A seal 82 is disposed in recess 80 and forms an effective seal between clamp 22 and top shelf trim piece 46.

Referring now to FIGS. 1 and 3, a spring biasing assembly 82 biases pivot plate 50 to maintain glass door 16 in an open position for loading items into or removing items from the refrigerated display case. Pivot plate 50 of hinge 20 is movable to a first, e.g., closed position (such as shown in FIG. 2), and a second, e.g., open position (not shown) wherein glass door 16 is pivoted upwardly for loading or removal of items from the refrigerated display case. Spring biasing assembly 82 includes a curved plate member 84 which is pivotally attached at one end thereof to first vertically extending member 54 and second vertically extending member 56 via rod 86. More particularly, curved plate member 84 includes a bore formed therein (not shown) through which rod 86 extends.

At an edge of curved plate 84 disposed opposite from the edge having the bore for receiving rod 86 is a generally planar face 88 (FIG. 3) having three internally threaded openings (not shown) for threadably receiving elongated threaded members 90, 92 and 94. Threaded members 90, 92 and 94 extend through end plates 96, 98 and carry respective compression springs 100, 102 and 104 radially thereabout. Referring to FIG. 1, end plate 96 includes outwardly extending tabs 106 which extend through rectangular openings 108 formed in depending legs 32, 34. Each of elongated threaded members 90, 92 and 94 is threadably engaged at one end thereof with the threaded openings formed in planar face 88, as shown in FIG. 3. Elongated threaded members 90 and 94 include a slotted head for rotating threaded members 90 and 94 into threaded engagement with curved plate member 84. Similarly, threaded member 92 includes a hex head for rotation thereof. Each of threaded members 90 and 94 slidably pass through an opening formed in end plates 96, 98. In contrast, threaded member 92 threadably engages an internally threaded boss 110 of end plate 98, whereby upon rotation of threaded member 92 end plates 96 and 98 may be moved relative to each other along a longitudinal direction of threaded members 90, 92 and 94. By moving end plates 96, 98 relative to each other, a desired preset can be placed upon compression springs 100, 102 and 104, whereby a desired lifting force can be exerted upon glass door 16 when in the upright position.

In operation, with door 16 of the display case in a downwardly closed position, as shown in FIG. 2, seals 78 and 82 of hinge assembly 10 effectively maintain a thermal seal to prevent excessive heat transfer. In the closed position, compression springs 100, 102 and 104 are in a compressed state. When door 16 is raised to an upwardly, open position, pivot plate 50 pivots about rod 52 and relative to mounting bracket 24, whereby glass door 16 is in a vertically upward position. During rotation of pivot plate 50, rod 86 likewise rotates downwardly about rod 52 into a lowered position and causes planar face 88 of curved plate member 84 to move in a generally longitudinal direction along threaded members 90, 92 and 94 and away from end plate 96. As curved plate member 84 moves in a generally axial direction along threaded members 90, 92 and 94, end plate 98 and springs 100, 102 and 104 pivot slightly at tabs 106 of end plate 96 within rectangular openings 108. Each of threaded members 90, 92 and 94 are slidably disposed within end plate 96 and thus end plate 98 moves away from end plate 96 and allows expansion of springs 100, 102 and 104. The force exerted on curved plate member 84, and in turn pivot plate 50, by the expanded compression springs 100, 102 and 104 is sufficient to maintain glass door 16 in the upright, open position. To close the door, a user simply pulls in a downwardly direction on glass door 16, which pivots rod 86 upwardly about rod 52 to force end plate 98 towards plate 96 to compress compression springs 100, 102 and 104, thereby allowing glass door 16 to move to the downwardly closed position.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A refrigerated display case, comprising:

a frame;

a glass door; and a hinge assembly interconnecting said frame and said glass door, said hinge assembly pivoting about a horizontal axis and including:

a hinge movable between a first position and a second position, said hinge including a spring biasing means for biasing said hinge to one of said first position and said second position; and a clamp including a first part connected to said hinge and a second part adjustably connected to said first part, said first part and said second part frictionally engaging said glass door therebetween, said hinge including a mounting bracket, a pivot plate mounted on said clamp, a first pivot means pivotally connecting the pivot plate to the mounting bracket, a pressure plate, second pivot means pivotally connecting the pressure plate to the pivot plate, said pressure plate carrying an elongated planar face offset from said second pivot means, said spring bias means including a coil spring mounted on said mounting bracket, and means for transferring the force of said coil spring to the elongated planar face of said pressure plate.

2. The display case of claim 1, wherein said spring biasing means comprises a compression spring.

3. The display case of claim 1, further comprising an elastomeric member disposed between said glass door and at least one of said first part and said second part.

4. The display case of claim 3, wherein said elastomeric member comprises a means for sealing between said glass door and said first and second parts, and for providing a cushion between said glass door and said first and second parts.

5. The display case of claim 1, wherein said glass door comprises a thermopane glass door.

6. The display case of claim 1, wherein said means for transferring is an elongated member.

7. The display case of claim 6, wherein said coiled spring is compressed between a pair of end plates, said elongated member extending through one of said end plates to engage said pressure plate.

8. The display case of claim 7, wherein said elongated member is threadedly connected to said one end plate whereby the compression of said coil spring may be adjusted by adjusting the elongated member relative to the end plate.

9. A hinge assembly for interconnecting a frame and a glass door of a refrigerated display case, said hinge assembly being pivotable about a horizontal axis and comprising:

a hinge movable between a first position and a second position, said hinge including a spring biasing means for biasing said hinge to one of said first position and said second position; and a clamp means connected to said hinge for holding said glass door using only frictional force, said hinge including a mounting bracket, a pivot plate mounted on said clamp, a first pivot means pivotally connecting the pivot plate to the mounting bracket, a pressure plate, second pivot means pivotally connecting the pressure plate to the pivot plate, said pressure plate carrying an elongated planar face offset from said second pivot means, said spring bias means including a coil spring mounted on said mounting bracket, and means for transferring the force of said coil spring to the elongated planar face of said pressure plate.

10. The hinge assembly of claim 9, wherein said clamp means comprises a first part connected to said hinge and a second part adjustably connected to said first part, said first part and said second part clamping said glass door therebetween.

11. The hinge assembly of claim 9, wherein one of said first and second parts includes a first opening and an other of said first and second parts includes a second opening disposed substantially coaxial with said first opening and further comprising a threaded bolt extending through said first opening and at least partially through said second opening.

12. The hinge assembly of claim 9, wherein said glass door comprises a thermopane glass door.

13. The display case of claim 9, wherein said means for transferring is an elongated member.

14. The display case of claim 9, wherein said coiled spring is compressed between a pair of end plates, said elongated member extending through one of said end plates to engage said pressure plate.

15. The display case of claim 9, wherein said elongated member is threadedly connected to said one end plate whereby the compression of said coil spring may be adjusted by adjusting the elongated member relative to the end plate.

* * * * *